United States Patent [19]

Danley

[11] Patent Number: 4,763,358

[45] Date of Patent: Aug. 9, 1988

[54] ROTARY SOUND TRANSDUCER

[75] Inventor: Thomas J. Danley, Highland Park, Ill.

[73] Assignee: Intersonics Incorporated, Northbrook, Ill.

[21] Appl. No.: 942,302

[22] Filed: Dec. 16, 1986

[51] Int. Cl.[4] ..... H04R 1/02; H04R 7/00

[52] U.S. Cl. ..... 381/156; 310/80; 340/390; 340/404; 381/153

[58] Field of Search ..... 381/156, 153, 150, 192, 381/193, 202; 310/80; 340/384 R, 390, 404–406

[56] References Cited

U.S. PATENT DOCUMENTS

| | | | |
|---|---|---|---|
| Re. 31,667 | 9/1984 | Knauff | 340/648 |
| 1,333,703 | 3/1920 | Brinks | 340/390 |
| 1,714,516 | 5/1929 | Milecz | 381/156 |
| 2,429,068 | 10/1947 | McIver | 381/192 |
| 2,550,359 | 4/1951 | Levy | 381/156 |
| 4,564,727 | 1/1986 | Danley et al. | 381/162 |

FOREIGN PATENT DOCUMENTS

| | | | |
|---|---|---|---|
| 126717 | 2/1932 | Austria . | |
| 2743908 | 4/1979 | Fed. Rep. of Germany | 310/80 |
| 262659 | 5/1970 | U.S.S.R. | 310/80 |

*Primary Examiner*—Jin F. Ng
*Assistant Examiner*—Danita R. Byrd
*Attorney, Agent, or Firm*—Juettner Pyle Lloyd & Verbeck

[57] ABSTRACT

At least one rotary vane in a tube is driven by a motor in response to an audio signal, causing production of sound through at least one opening in the tube.

9 Claims, 2 Drawing Sheets

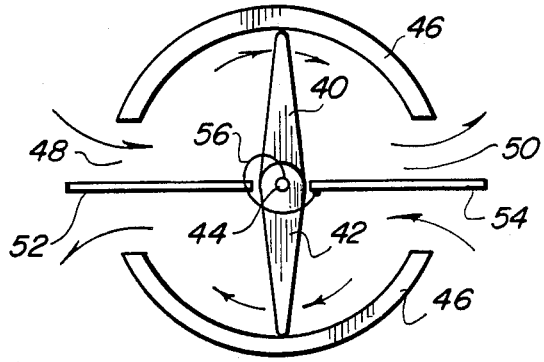
FIG. 4
FIG. 3
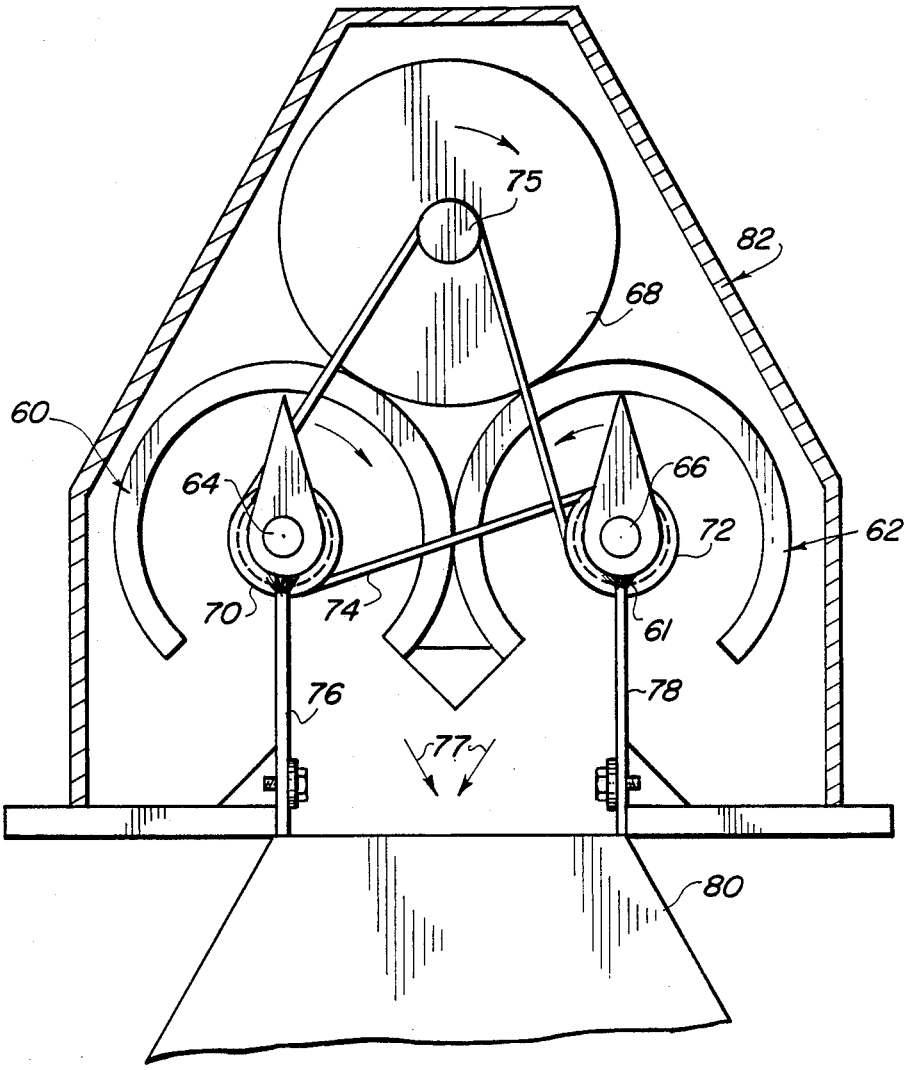

ROTARY SOUND TRANSDUCER

BACKGROUND OF THE INVENTION

This invention relates to transducers or loudspeakers which are driven by a rotary drive means rather than by a conventional voice coil.

As described in U.S. Pat. No. 4,564,727, incorporated herein by reference, a greatly superior subwoofer having a very high power handling capacity is made possible by using a commutated servomotor as the drive, rather than a conventional voice coil. In such a device, the motor shaft is connected by a linkage to one or more diaphragms. The use of a commutated rotary motor allows for unlimited excursions of the diaphragm at high power levels. In order to accomplish this result, it is necessary to use a suitable device to convert rotary motion of the motor into linear motion at the diaphragm. The diaphragm may take the form of a panel or of a heavy duty speaker cone.

In producing sound of high intensity, especially at low frequencies, there are several limiting factors in conventional systems. Conventional speakers for many years have used electromagnetic voice coils, which have numerous inherent limitations. Some of these limitations include limited excursion due to limited coil length and resistance, limited heat capacity, and limited magnet size. Also, the most modern speaker cones have a limited excursion of a maximum of about one-half inch. Since available acoustic source strength is dependent on the displacement or surface area of the radiator or diaphragm, the prior art has proposed the use of larger speakers in large enclosures. In order to drive the speaker, larger and heavier voice coils must be employed, which result in severe resistive heat losses and possible thermal degradation of the voice coil.

While the servo-drive loudspeaker of U.S. Pat. No. 4,564,727 overcomes or avoids most of the aforesaid problems, it would be desirable to provide further improvements to simplify the system and provide a low frequency transducer with fewer moving parts and smaller overall size.

SUMMARY OF THE INVENTION

The present invention comprises a rotary transducer in which a commutated motor is connected to an amplified signal, which serves to drive the motor shaft in both rotary directions in response to the signal. The sound radiating portion of the transducer comprises a vane, which is mounted for rotation in a cylinder. An opening is provided along the length of the cylinder, and the opening is divided radially by a baffle. The vane is mounted on a rotary shaft along the axis of the cylinder, and the shaft is driven by the motor.

The baffle defines forward and rearward radiation ports from the cylinder opening. Receipt of an electrical acoustic signal by the motor causes the motor shaft to rotate back and fourth rapidly. The motor drives the vane, which compresses or rarefies the air in the cylinder, causing production of sound. The forward sound port may be connected to a horn for an improved impedance match with the listening environment. The rear port may be connected to an enclosure.

The rotary transducer of the present invention offers several advantages. The apparatus requires fewer working parts than conventional transducers and is more reliable in operation. In terms of cabinet size, the transducer of the present invention is very compact yet capable of producing an air displacement which exceeds that of larger conventional units. The use of a vane or paddle to move the air is well adapted to the production of low frequency sound in which large volumes of air must be displaced.

THE DRAWINGS

FIG. 3 is a sectional view from one end of another embodiment of the present invention.

FIG. 4 is an end view of another embodiment of the rotary transducer, with the end cover being removed to show the inner structure.

DESCRIPTION OF THE PREFERRED EMBODIMENTS

Figure 1:
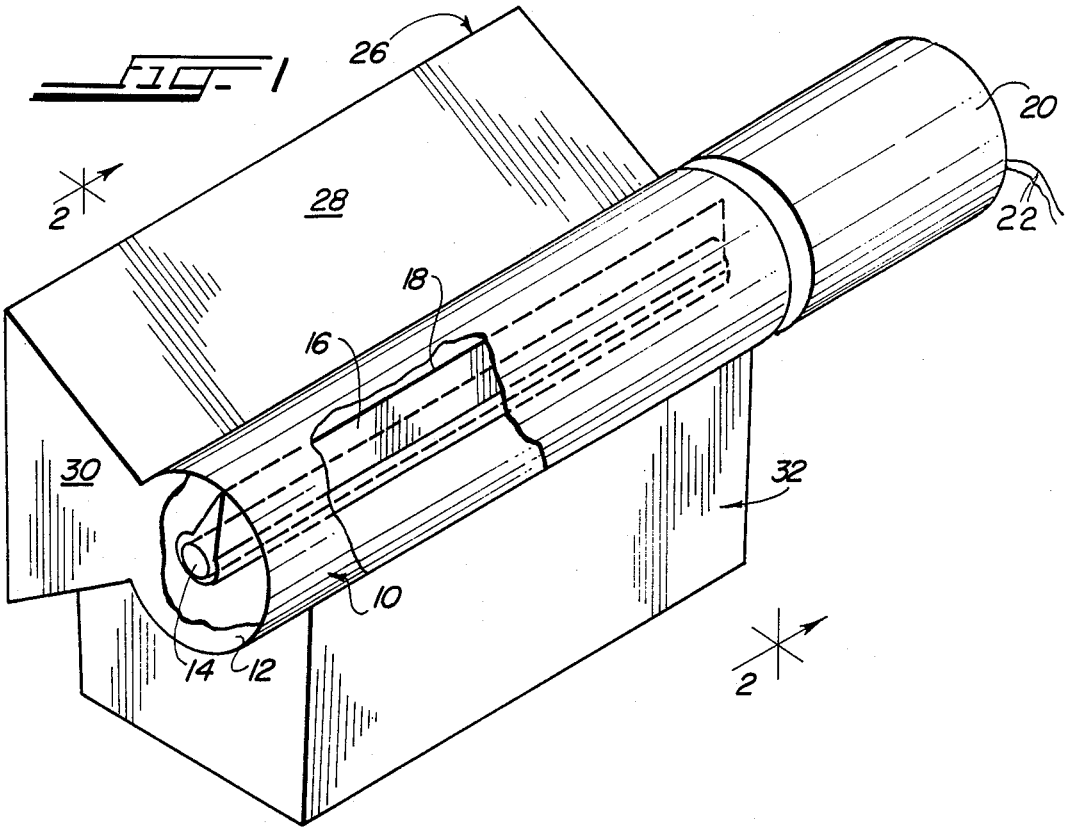
FIG. 1 is a perspective view of the rotary transducer of the present invention.
Figure 2:
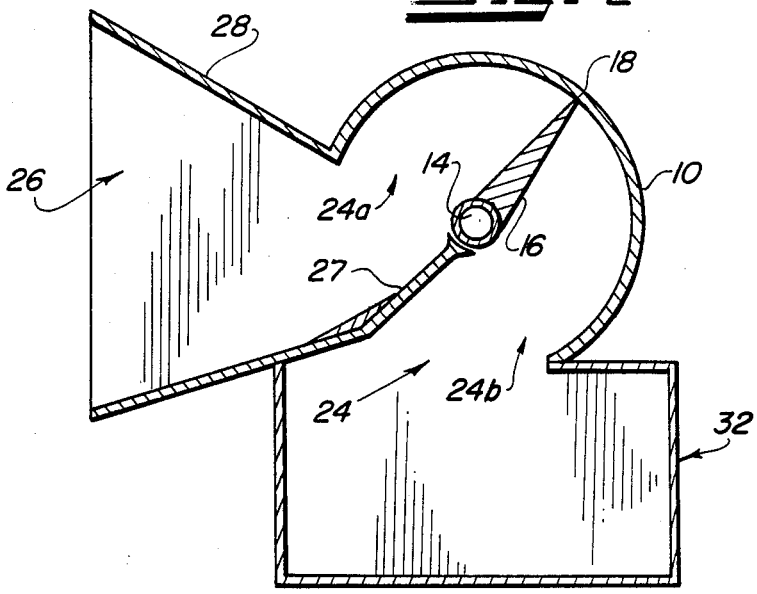
FIG. 2 is a sectional view taken along line 2—2 of FIG. 1.

As shown in FIGS. 1 and 2, the rotary transducer of the present invention generally comprises a cylinder or tube 10 having end walls 12 and a shaft 14 within the tube located axially therein. The shaft 14 may be mounted for rotation in suitable bearings (not shown) carried in the end walls 12.

A rectangular, outwardly tapering vane 16 is secured along one longitudinal edge thereof to the shaft. The opposite longitudinal edge 18 of the vane is closely spaced from the inner curved wall of the tube 10. The ends of the vane are also closely spaced from the end walls 12. The radial vane 16 therefore divides the volume of the cylinder along the length thereof.

The vane 16 is essentially planar or tapered and is composed of low density materials which offer sufficient rigidity to withstand the forces being encountered. Reinforced composite materials composed of sheets or portions of metal or plastic and foam are particularly suitable. For example, a sandwich of sheets of aluminum and foam or other reinforced foam structures may be employed.

Means are provided for rotating the shaft 14 and the vane 16 in the tube 10. In the preferred embodiment, the drive means comprises a high speed low inertia DC commutated servometer 20. The term "comutated" is intended to mean that the coil of the motor is immersed in a magnetic field, and the current is transferred or switched in the active portion of the coil as it is rotated. As a result, the force per unit current on the shaft remains constant, irrespective of the rotary position or degree of rotation of the shaft. One type of suitable motor is sold under the name Electro-Craft as model No. M-1450/M1460 or Honeywell 4VM62.

The sound signal source (not shown) is connected to the leads 22 of the motor. The signal is amplified to a level which is sufficient to drive the motor. As a result, the output shaft of the motor rotates back and forth in response to the signal at a frequency and intensity corresponding to the frequency and intensity of sound to be produced. If desired, a feedback device may be included.

The shaft 14 may be an axial extension of the motor shaft, or in any event, the motor shaft is operatively connected to the shaft 14, such that rotation of the motor shaft causes rotation of shaft 14 and vane 16.

As best illustrated in FIG. 2, the tube 10 is provided with an elongated slit or opening 24 between the ends of the tube. The opening 24 may be formed by removing a cylindrical segment of the tube wall, corresponding to the length of the vane. The opening 24 is divided or bisected by an elongated rectangular baffle 27 having one edge extending along and closely adjacent the shaft 14 to substantially form a seal, with the other edge extending radially toward the exterior of the tube. The interior edge of the baffle may terminate in a brush, as shown at 61 in FIG. 3, in order to provide a better air seal. The baffle 7 therefore divides the opening 24 into a pair of openings or ports **24*a* and 24*b***. Preferably, as shown, the opening are of equal size, although other configurations may be employed.

As shown in the drawings, one of the openings **24*a* may be connected to the elongated throat of a horn 26 having outwardly diverging walls 28 toward the mouth thereof and suitable end walls 30. The other opening 24*b* may be connected to a sealed enclosure such as 32. The openings 24*a* and 24*b* receive the forward and rear or opposite phase sound radiation created by the vane 16**. Also, it will be understood that the use of a horn and sealed box represents only a preferred arrangement of a variety of ones available. For example, the rear radiation could be baffled by an enclosure and vented in phase with the forward radiation, and a variety of horn configurations could be employed.

It may be seen that the vane 16 acts as a sound radiating surface upon rotation of the vane with the shaft. Since close spacing is maintained between the vane and the other adjacent surfaces within the tube, the vane is substantially sealed in the tube and serves to displace a cylindrical segment of air as the vane is rotated in either direction.

In operation, the vane 16 will assume a neutral position approximately parallel with the baffle 27. The motor 20 receives oscillating amplified electrical signals from an audio source, causing the vane to rotate back and forth as driven by the motor. The vane alternatively compresses and rarefies the air in the tube on each side of the baffle, causing generation of sound at a frequency and intensity corresponding to the frequency and amplitude of the source.

As shown, the vane 16 is capable of rotating in an arc in excess of 90° in either direction relative to a neutral position. Depending on the length and diameter of the tube, the opening of the slit, and the size of the vane, a rotation of up to approximately 130° or greater is feasible before the edge of the opening 24 is reached by the tip of the vane. In any event, the system is designed with enough reserve capacity such that this limit will not be exceeded. Also, smaller diameter tubes require less rotational inertia of vane material for a given volume displacement, whereas the tube may be constructed of any desired length to increase displacement or effective excursion.

Although not shown, a torsion spring may be connected to the vane or motor shaft to provide a restraining force against rotation in both directions. This would tend to reduce nonlinearity in the production of sound due to the varying volume of the enclosure and also would serve to help restore the vane to a central or neutral position.

FIG. 3 illustrates another embodiment of the present invention in which a pair of rotary vane devices 60 and 62 are utilized. The diaphragm portion of the transducer is similar to the embodiment described in terms of a vane rotating with a shaft inside a tube, and this portion will not be described again in detail.

In the embodiment of FIG. 3, the rotary vane devices are mounted in parallel with the openings in the tubes facing in the same direction. The shafts 64 and 66 of the devices are driven by a common motor 68. Pulleys 70 and 72 are provided on corresponding ends of the shafts 64 and 66. A belt 74 in the form of a high strength steel cable or other material is wrapped around the motor shaft 75 a number of turns to obtain a positive drive. The belt is then wrapped around and between the pulleys 70 and 72 and is crossed or twisted between the pulleys as shown. This feature causes the shafts 65 and 66 to rotate in opposite directions as the motor shaft 75 is rotated in either direction.

As in the previous embodiment, the openings in the tubes are divided by baffles 76 and 78. In this fashion, the forward radiation of both tubes, indicated by arrows 77, is combined in the space between the baffles 76 and 78, which may be the throat of a horn 80. The rear radiation, indicated by arrows 79, may be contained in the cabinet enclosure, indicated generally at 82.

The dual tube shown in FIG. 3 may be advantageous for certain applications requiring a high sound output in a minimum of cabinet space. Also, the use of oppositely rotating vanes into a common output may allow for a better balance between the motor and the sound radiating portions and easier implementation into a system.

FIG. 4 illustrates yet another version of the rotary transducer of the present invention. In this case, a pair of vanes 40 and 42, which may be connected together, are secured on a common shaft 44 and extend in opposite directions within a tube 46. The tube 46 has a pair of openings 48 and 50 at 90 degrees from the neutral position of the vanes. The openings are bisected by baffles 52 and 54 in sealing engagement with the shaft 44, as aforesaid. The shaft 44 is connected to a servomotor as described in the previous embodiments. Also shown is a helical spring 56 connected between the shaft and one of the baffles to urge the vanes back into the neutral position as shown.

As the vanes 42 are urged in one rotary direction, as shown by the arrows, air is displaced in the directions indicated on either side of the tube. Rotation in the other direction will displace air in the direction opposite to that indicated in the arrows. This version offers several advantages, such as a balanced load on the drive shaft. Also, in comparison with a single vane unit, only one-half of rotation or rotary angle is required for the same total In addition, the size of the pulleys may be adjusted to alter the drive ratio between the motor and the driven shafts. For example, it may be desirable to have a higher or lower rotation of the motor shaft in comparison with the driven shafts, in order to obtain a mechanical advantage.

It may be seen that the rotary sound device of the present invention operates on a principle which is fundamentally different from a conventional transducer. All present day transducers use a linear drive to operate or reciprocate a piston—like radiator to displace a volume of air which is symmetrical about the axis of the piston. In such devices, the volume of displacement is defined as the area of the radiator times its displacement or excursion. The radiator is normally a flexible cone driven by a linear voice coil, and there are practical limits on cone diameter and maximum displacement.

In the present invention, a radiator displaces a cylindrical segment of air by driving a vane about an axis with a rotary drive. There are no limits on excursion using a commutated drive, and displacement is easily increased by increasing the volume (length or diameter) of the tube. As an example, a 15 inch cone radiator having a one-half inch peak to peak excursion may be replaced by a 9 inch long tube having a 3.5 inch inner diameter and plus or minus 135 degree rotation.

I claim:

1. A transducer for producing sound in response to an audio signal comprising a cylindrical enclosure having an axis, an opening in the enclosure, a vane mounted for rotation about said axis, and rotary motor means connected to said audio signal for rotating said vane back and forth to produce sound through said opening.

2. The transducer of claim 1 wherein said motor means is commutated.

3. The transducer of claim 1 wherein the vane is mounted on a driving shaft, and said motor has an output shaft connected to said driving shaft.

4. The transducer of claim 1 wherein the output shaft of the motor is coaxial with the driving shaft of the vane.

5. The transducer of claim 1 wherein baffle means are provided for dividing said opening into a pair of ports which receive sound radiation in opposite phases from said vane.

6. The transducer of claim 5 wherein one of said ports is connected to a throat of a horn.

7. The transducer of claim 6 wherein the other of said ports is connected to an enclosure.

8. A transducer for producing sound in response to an audio signal, said transducer comprising a hollow cylinder having an axis and an interior cylindrical wall, an elongated vane mounted for rotation about said axis, said vane extending between said axis and said interior wall of said cylinder, motor means having a rotary output shaft for rotating said vane in an arc back and forth in response to said audio signal to displace air and produce sound waves on opposite sides of the vane, and means disposed on opposite sides of the vane beyond the arc thereof for separately porting sound waves on opposite sides of the vane.

9. A transducer for producing sound in response to an audio signal, said transducer comprising a hollow cylinder having an axis and closed ends, an elongated opening in the cylinder between the ends there, vane means mounted for rotation about said axis to displace air toward said opening, means for dividing said opening extending from said axis outwardly, along said opening, and motor means for rotating said vane back and forth in response to said audio signal.

* * * * *